US007557319B2

(12) United States Patent
Zadesky et al.

(10) Patent No.: US 7,557,319 B2
(45) Date of Patent: Jul. 7, 2009

(54) ACTUATOR ASSEMBLY

(75) Inventors: Stephen P. Zadesky, Portola Valley, CA (US); Douglas J. Weber, Arcadia, CA (US); Pinida Jan Moolsintong, St. Louis, MO (US)

(73) Assignee: Apple Inc., Cupertino, CA (US)

( * ) Notice: Subject to any disclaimer, the term of this patent is extended or adjusted under 35 U.S.C. 154(b) by 141 days.

(21) Appl. No.: 11/519,286

(22) Filed: Sep. 11, 2006

(65) Prior Publication Data

US 2008/0060926 A1 Mar. 13, 2008

(51) Int. Cl.
*H01H 17/00* (2006.01)

(52) U.S. Cl. ..... 200/331

(58) Field of Classification Search ..... 200/329–331, 200/335, 275, 284, 279; 439/188
See application file for complete search history.

(56) References Cited

U.S. PATENT DOCUMENTS

| | | | | |
|---|---|---|---|---|
| 3,175,066 | A * | 3/1965 | Fiddler | 200/508 |
| 5,634,552 | A * | 6/1997 | Soberski | 200/284 |
| 2007/0119698 | A1 * | 5/2007 | Day | 200/510 |

* cited by examiner

*Primary Examiner*—Edwin A. Leon
(74) *Attorney, Agent, or Firm*—Kramer Levin Neftalis & Frankel LLP

(57) ABSTRACT

The present invention can include a mechanical actuator having an interface region and an actuation region that is thicker than the interface region. The interface region can provide an interface for a user to move the actuator. The actuation region can incorporate a feature that mates with an electronic component within an electronic device. When a user moves the interface region, that motion can be translated by the actuation region to actuate the electronic component. The present invention also includes methods of manufacturing the actuator.

23 Claims, 6 Drawing Sheets

ACTUATOR ASSEMBLY

FIELD OF THE INVENTION

The present invention can relate to methods and apparatus for providing robust yet thin actuators for use with electronic devices.

BACKGROUND OF THE INVENTION

As many consumer electronic devices increasingly small, many of the mechanical and structural components inside the devices also become small. For example, small structural mechanisms, like actuators often need to be thin, but also be rigid and have sufficient structural integrity. However, as parts become smaller, it can become more difficult to manufacture the parts.

Some electronic devices have sliders, or actuators, that provide interfaces for a user to mechanically actuate a component disposed within the device. For example, Apple Computer, Inc. of Cupertino, Calif. markets a line of iPod™ devices that have hold-switch sliders. A hold-switch slider can allow a user to actuate an electronic hold-switch component located within the housing of the device. When activated, the electronic hold-switch component—i.e., the component that communicates with the electrical circuit—can lock down the iPod™ to prevent a user from unintentionally changing the current operational state of the iPod™.

It may be desirable to design the hold-switch slider to be robust to withstand a large number of cycles. However, it also is desirable to design hold-switch sliders to be thin so that they may sit in very tight areas of the iPod™ devices and yet be easily manufacturable so that the hold-switch slider can be mass produced.

In some electronic devices, actuators that allow a user to actuate an electronic component located within the device may have a single thickness. A single thickness is generally easy to manufacture, but not necessarily capable of withstanding repeated loads. That is, over time the mating region of the actuator may wear more quickly because the load on the actuator may not be distributed over a large region.

In other devices, actuators may weld two pieces together to thicken the mating region. However, because the mating region of the actuator can be very small, the actuator may be difficult to manufacture because of the difficulty involved in fixturing and welding two small pieces.

SUMMARY OF THE INVENTION

One embodiment of the present invention is a mechanical actuator having an interface portion and an actuation portion that is thicker than the interface portion. The interface portion can provide an interface for a user to slide the actuator. The actuation portion can incorporate a feature that mates with an electronic component within an electronic device. When a user moves the interface portion, that motion can be translated by the actuation portion to actuate the electronic component.

In one embodiment of the present invention, the actuation portion may have a thickness that at least is double that of the interface portion. The actuator may be manufactured by folding over a portion of the actuator to create the double thickness.

A method of forming a hold-switch actuator according to the invention may include stamping a hold-switch slider form. Then the method may include folding a portion of the form to create a double thickness portion of the form. The method may also include stamping a cutout from the double thickness portion of the form. In one aspect of the invention, the cutout may mate with a protuberance, when actuated, directly actuates an electronic circuit.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
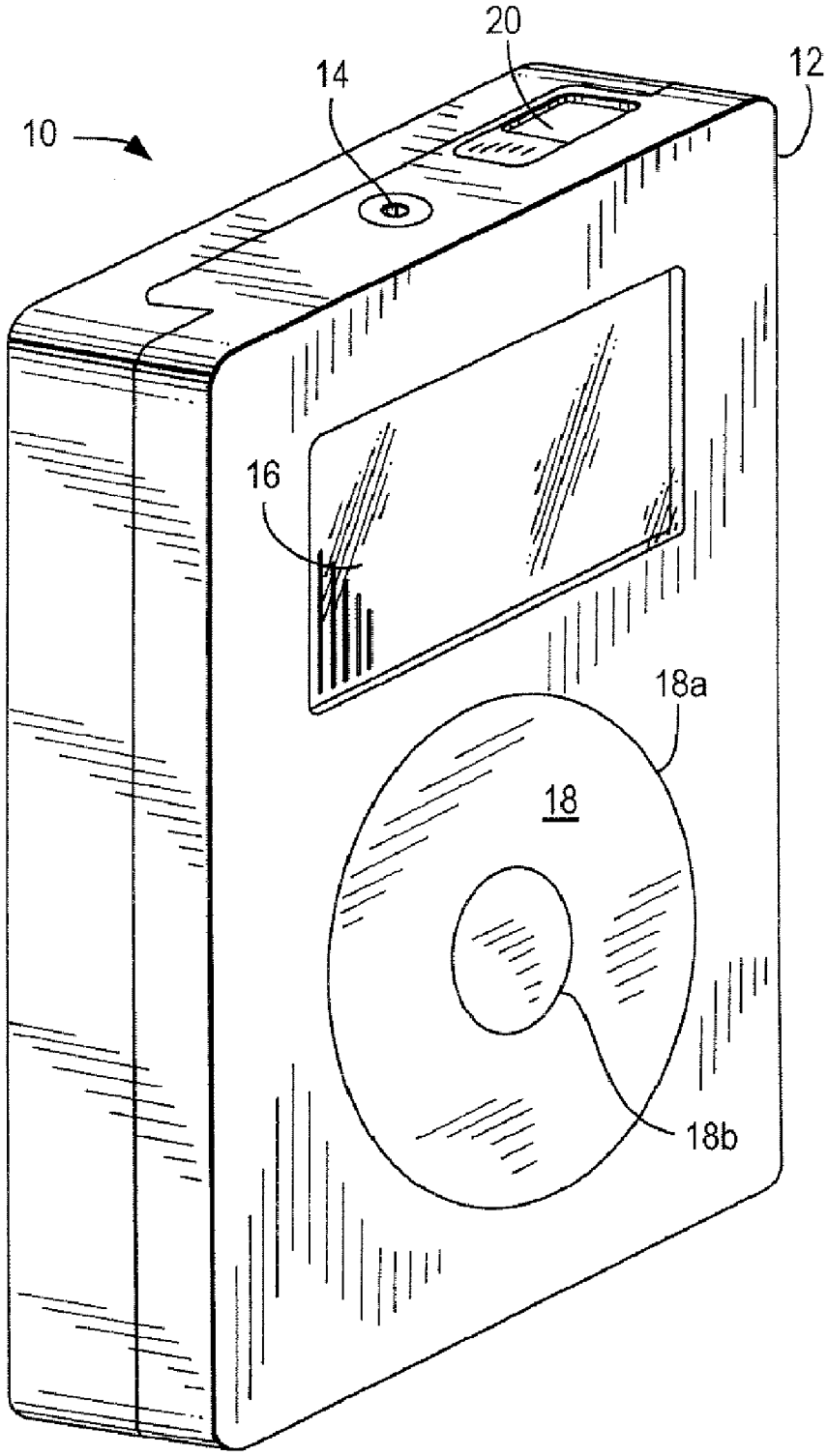
FIG. 1 illustrates an exemplary electronic device that can include the present invention.

FIG. 1 illustrates an exemplary electronic device that can incorporate the present invention. Electronic device 10 can be any electronic device, including any portable, mobile, hand-held, or miniature consumer electronic device having an actuator that provides an interface for a user to mechanically actuate a component disposed within the device. Illustrative electronic devices can include, but are not limited to, music players, video players, still image players, game players, other media players, music recorders, video recorders, cameras, other media recorders, radios, medical equipment, calculators, cellular phones, other wireless communication devices, personal digital assistances, programmable remote controls, pagers, laptop computers, or combinations thereof.

Miniature electronic devices have a form factor that is generally smaller than that of hand-held devices. Illustrative miniature electronic devices can include, but are not limited to, watches, rings, necklaces, belts, accessories for belts, headsets, accessories for shoes, virtual reality devices, other wearable electronics, accessories for sporting equipment, accessories for fitness equipment, or combinations thereof.

In one embodiment of the present invention, electronic device 10 can be iPod™. Electronic device 10 can include housing 12, accessory connector 14, display 16, user input component 18, and hold-switch 20. Accessory connector 14 can mechanically and electrically couple to a complementary connector from an accessory device, e.g., an accessory similar to those compatible with an iPod™. Accessories can include a computer, a printer, a display, speakers, audio system, headphones, a dock, a lanyard, or a combination thereof. User input component 18 can provide an interface for a user to input data into electronic device 10, e.g., a scroll wheel similar to that used by an iPod™. The scroll wheel can include one or more buttons 18*b* that may permit a user to select software entries and touchpad 18*a* that may permit a user to scroll through software menus. In alternative embodiments, user input component 18 may include, for example, one or more buttons, a touchpad, a touchscreen display, electronics for accepting voice commands, antennas, infra red ports, or combinations thereof.

Hold-switch 20 can allow a user to actuate an electrical hold-switch component located within housing 12 of the device. When actuated, the electrical hold-switch component can lock down the electronic device to prevent a user from unintentionally changing the current operational state of the device.

To withstand the large number of cycles to which hold-switch 20 may be subjected, it may be desirable to design a robust hold-switch. It also may be desirable to design the hold-switch to be sufficiently thin to be placed in a very small space of the electronic device and to be easily manufacturable so that the hold-switch can be mass produced.

The present invention can include a hold-switch that can be disposed within an area having tight space constraints and can distribute loads applied to the slide over a large surface area. In some embodiments, The hold-switch of the present invention also can be easily manufactured.

Figure 2A:
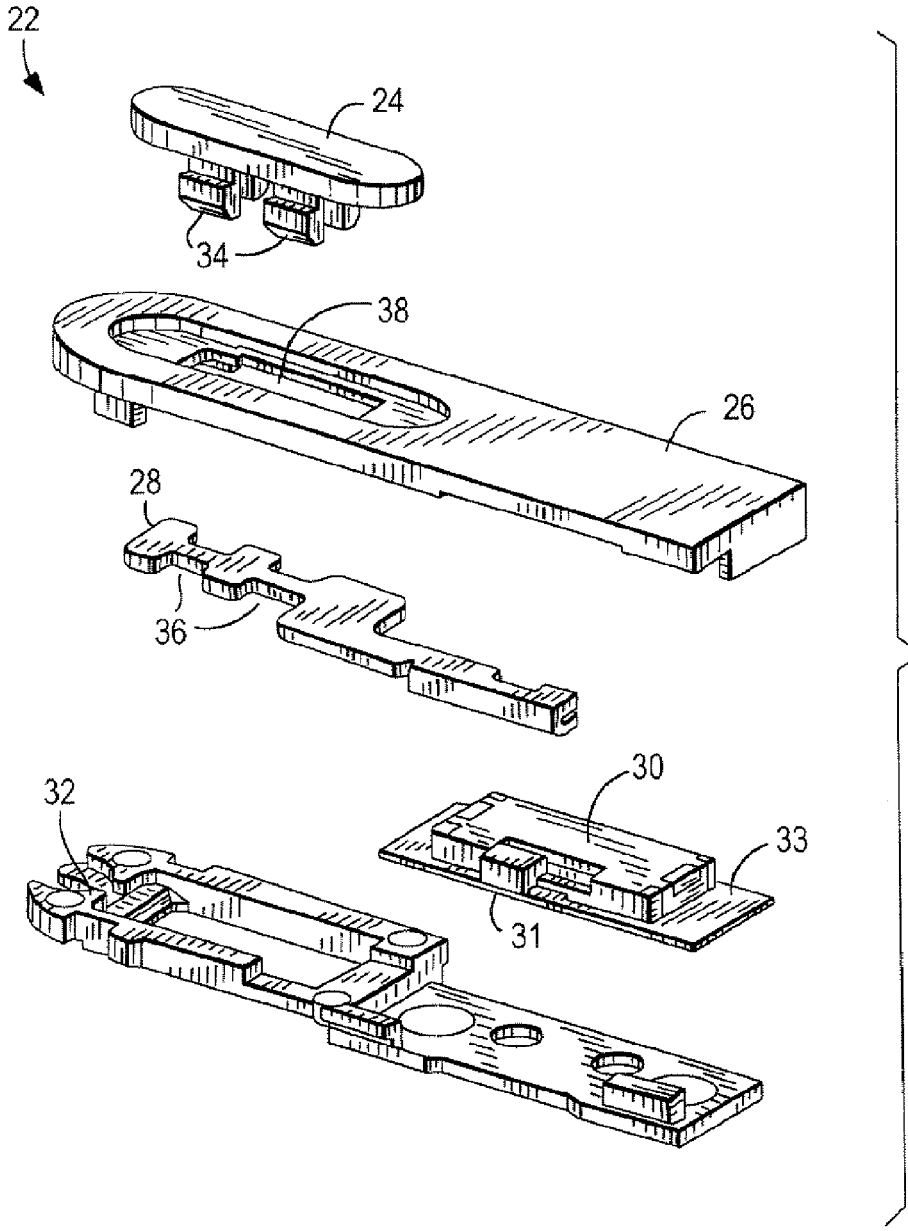
FIGS. 2A-C illustrate an actuator assembly in accordance with one embodiment of the present invention.
Figure 2B:
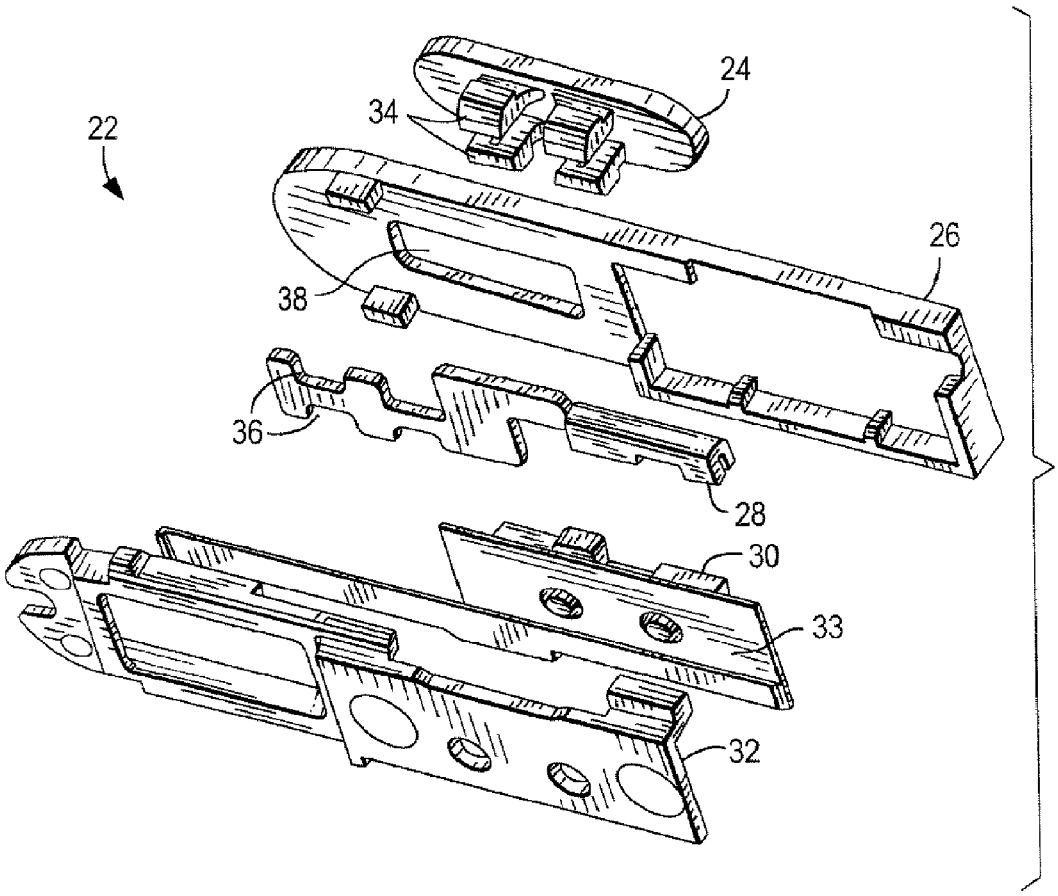
Figure 2C:
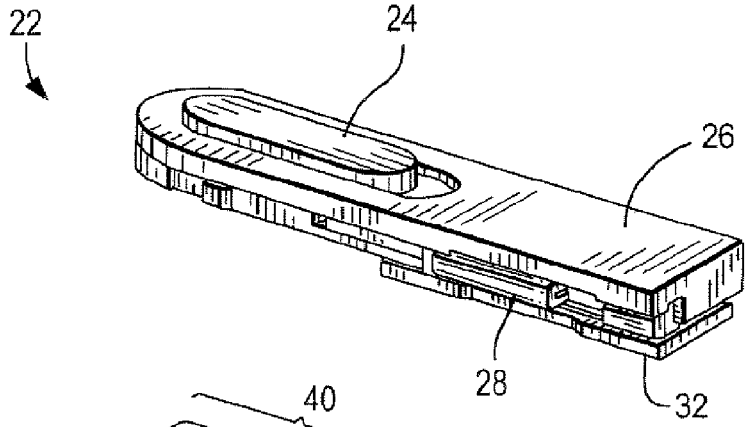

FIGS. 2A-C illustrate hold-switch assembly 22 of the present invention. Hold-switch assembly 22 can include hold-switch user interface 24, faceplate 26, hold-switch slider 28 (also referred to herein as a hold-switch actuator), electrical hold-switch 30, and hold-switch support 32. Hold-switch support 32 can provide a base from which the other components of hold-switch assembly 22 can be mounted.

Hold-switch user interface 24 can be disposed on an outer surface of housing 12 to provide an interface for the user to actuate the hold-switch. Hold-switch user interface 24 can include one or more protuberances 34 that may be configured to mechanically engage slots 36 in hold-switch slider 28. When a user slides user interface 24 along track 38 in faceplate 26, the motion is translated to hold-switch slider 28.

Faceplate 26 may include slot 38 through which protuberances 34 of hold-switch user interface 24 may be disposed to engage hold-switch slider 28. Slot 38 may act as a track that constrains the motion of hold-switch user interface 24 in one direction. When hold-switch interface 24 is disposed at one end of slot 38, electrical hold-switch 30 can transmit a signal or signals that indicate one state (e.g., lock down the electronic device). When hold-switch interface 24 is disposed at the other end of slot 38, electrical hold-switch 30 can transmit a signal or signals that indicate a second state (e.g., unlock the electronic device).

In alternative embodiments of the present invention, the hold-switch can indicate additional states. For example, when hold-switch interface 24 is disposed at the middle of slot 38, electrical hold-switch 30 can transmit a signal or signals that indicate a third state (e.g., permit the user to change predetermined parameters of the electronic device while other predetermined parameters are locked down).

In one embodiment of hold-switch interface 24 having multiple states, slot 30 can also include various ridges or other assembly that provides tactile feedback when the slider is moved from one position to another. Such an assembly may be critical in providing the user with the information that the hold-switch interface is in the middle position. In the absence of such tactile feedback, it may be difficult to determine whether the hold-switch interface is in the middle state. In an additional embodiment of the invention, such tactile feedback may be implemented with respect to protuberance 31 of electrical hold-switch 30 (see, e.g., FIGS. 2A and 5A-B).

In alternative embodiments of the present invention, slot 38 may have another configuration (e.g., an "x" configuration) that permits hold-switch user interface 24 to move in more than one direction. This may be useful when the hold or lock function has more than two states that a user can set using a switch or when hold-switch also serves another function of the electronic device that also has multiple states that a user can set using a switch.

Figure 3A:
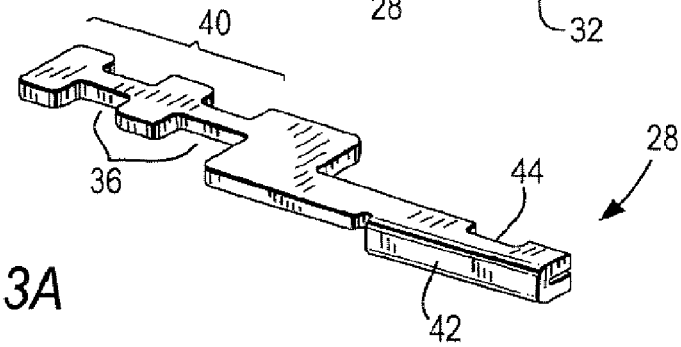
FIGS. 3A-C illustrate a component of the actuator assembly of FIGS. 2A-C in accordance with one embodiment of the present invention.
Figure 3B:
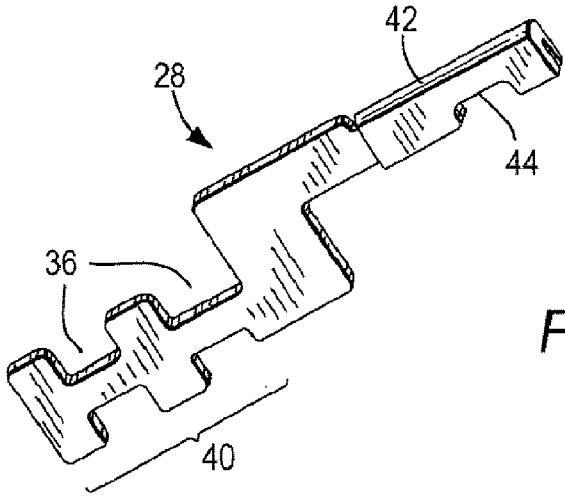
Figure 3C:
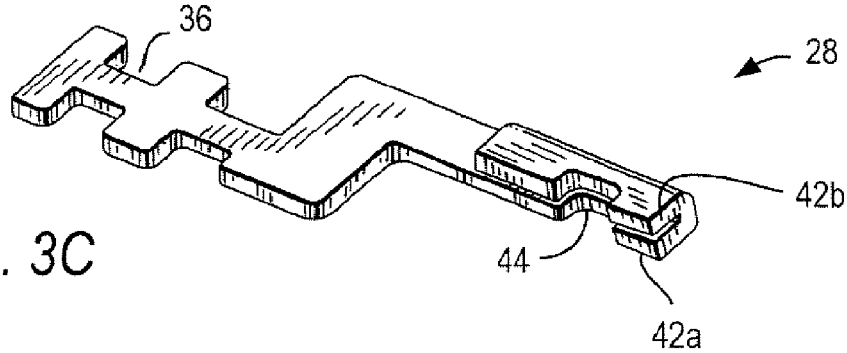

FIGS. 3A-C illustrate enlarged views of hold-switch slider 28. Hold-switch slider 28 can have interface portion 40 coupled to actuation portion 42. Interface portion 40 may include slots 36 configured to mechanically engage protuberances 34 of hold-switch user interface 24. Actuation portion 42 can include first layer 42*a*, second layer 42*b*, and cutout 44 that may be configured to mechanically engage protuberance 31 of electrical hold-switch 30 (see, e.g., FIGS. 2A and 5A-B). Cutout 44 may be tightly toleranced so that the cutout can mate properly with electrical hold-switch 30. A precise fit between cutout 44 and electrical hold-switch 30 may be important to provide smooth movement of hold-switch user interface 24 when a user actuates the interface.

When a user slides user interface 24, the motion is translated by interface portion 40 to actuation portion 42 of hold-switch slider 28. Cutout 44 then can actuate electrical hold-switch 30. In one embodiment of the present invention, actuation portion 42 may have approximately double the thickness of interface portion 40 to impart greater strength and thickness thereto. This can permit contact force between the hold-switch slider and the electrical hold-switch to be distributed over a larger surface area. The reduced stress can reduce wear on the part. Increased thickness of actuation portion 42 also can ensure that the hold-switch slide reliably engages the electrical hold-switch even while maintaining a thin profile. In one embodiment of the present invention, the thickness of interface portion 40 may be between about 0.20 mm and about 0.60 mm and the thickness of actuator portion 42 may be approximately double the thickness of the interface portion.

In FIGS. 2A-C, electrical hold-switch 30 is illustrated on a portion of flexible printed circuit (FPC) 33. Flexible circuit 33 can electrically couple electrical hold-switch 30 to a circuit board (not shown). Protuberance 31 of electrical hold-switch 30 may be configured to mechanically engage cutout 44 of hold-switch slider 28. When protuberance 31 is actuated (e.g., by sliding along an axis), a signal can be transmitted by the electrical hold-switch to a circuit board (not shown) to lock down the electronic device. This can prevent a user from accidentally changing the current operational state of the device.

Figure 4:
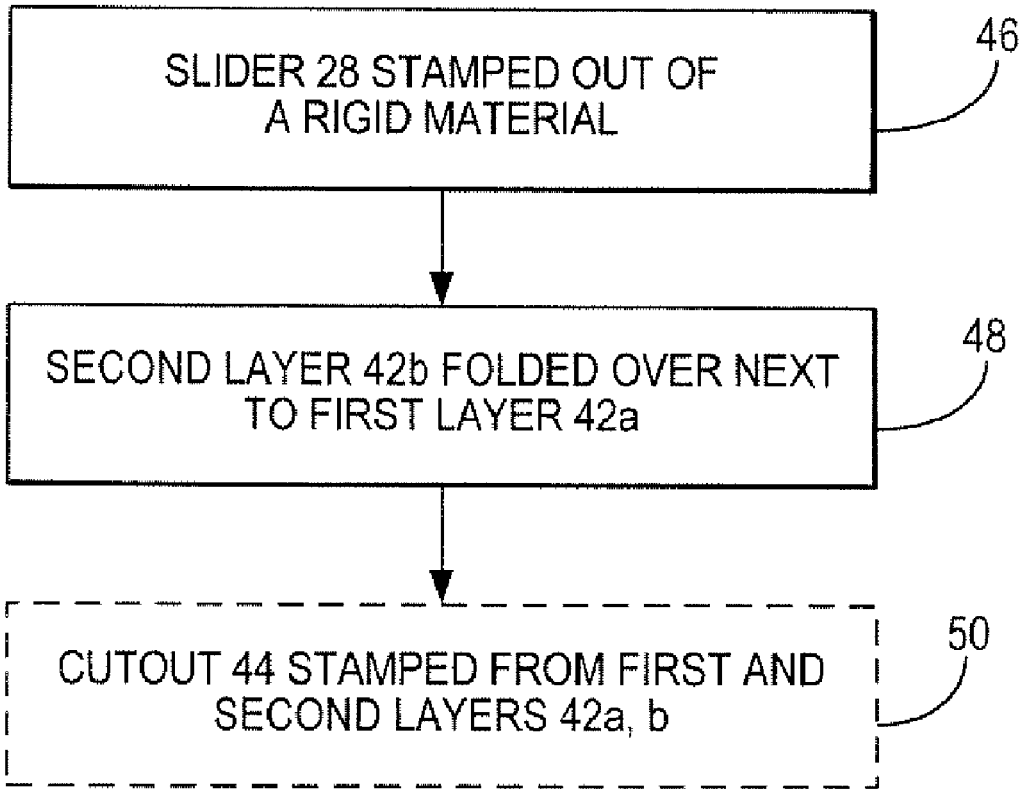
FIG. 4 provides a flowchart of steps for manufacturing the component of FIGS. 3A-C in accordance with one embodiment of the present invention.

FIG. 4 provides an exemplary flowchart of steps for manufacturing hold-switch slider 28. To manufacture hold-switch slider 28 in large quantities, the slider may first be stamped out of a rigid material (step 46), such as stainless steel. The stamping device can stamp the material so that the entire slider, including first and second layers 42*a* and 42*b* of actuation portion 42, is one continuous co-planar piece. To produce the increased thickness in actuation portion 42, second layer 42*b* can be folded next to first layer 42*a* (step 48), thereby doubling the thickness of actuation component 42.

In embodiment of the present invention, cutout 44 then can be stamped out from the actuation portion through both first and second layers 42*a,b* create a clean match between the two layers (step 50). In alternative embodiments, the cutout can be stamped into the slider in step 46 when the slider initially is stamped out of a rigid material or milled from the actuation portion.

Figure 5A:
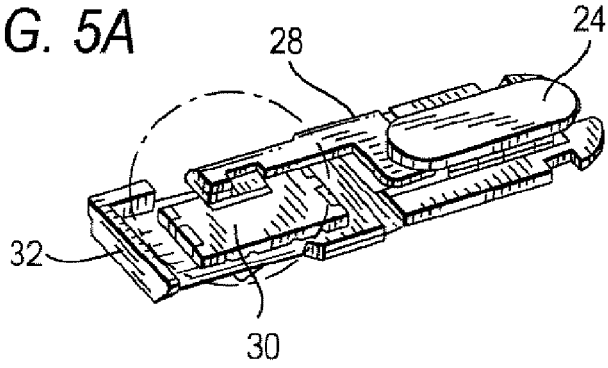
FIGS. 5A-C illustrate engagement of components of the actuator assembly of FIGS. 2A-C in accordance with one embodiment of the present invention.
Figure 5B:
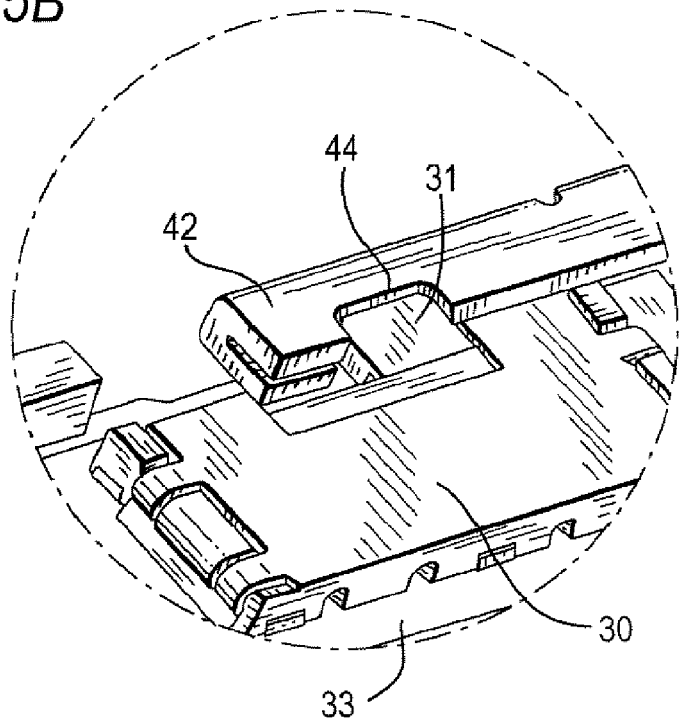
Figure 5C:
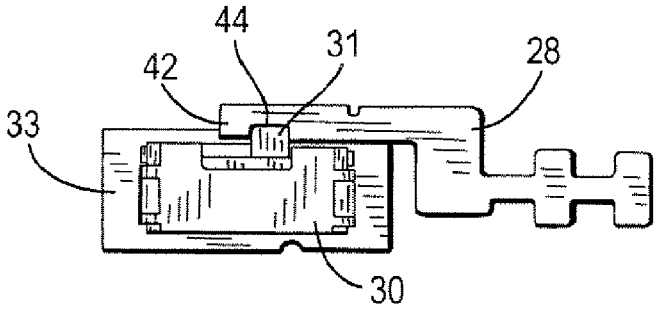

FIGS. 5A-C illustrate mechanical engagement of hold-switch slider 28 to electrical hold-switch 30. In one embodiment of the present invention, protuberance 31 of electrical hold-switch 30 may have a thickness that is less than that of actuation portion 42 of hold-switch slider 28. In one embodiment of the present invention, protuberance 31 may have a thickness between about 0.53 mm and about 0.93 mm, although other thicknesses can be used as well. When the protuberance is actuated, electrical hold-switch 30 can send a signal to a circuit board (not shown) to indicate whether the electronic device should be in one of two states.

Although particular embodiments of the present invention have been described above in detail, it will be understood that this description is merely for purposes of illustration. Alternative embodiments of those described hereinabove are also within the scope of the present invention. For example, while the description provided herein describes actuation portion 42 of hold-switch slide 28 as having approximately double the thickness of interface portion 40, the thickness of the actuation portion can have any value greater than, equal to, or less than the thickness of the interface portion.

Furthermore, while actuation portion 42 of hold-switch slide 28 of the above-described embodiments has been described as having two layers of material, the actuation portion can have more than two layers of material. During manufacturing, the additional layers of material can be stamped from a rigid material along with the remaining portions of the hold-switch slide as part of a single unitary piece and folded accordion-style to further increase the thickness of the actuation portion. Cutout 44 then can be stamped through all the layers of material of the actuation portion. Alternatively, cutout 44 could be stamped through all the layers with the first stamping or at some other time, and then the folding can occur.

While the description provided herein describes some components of an electronic device, the device may include additional components, e.g., multiple-pin connectors, antennas, speakers, microphones, and/or additional components of the electronic device that have not been shown for simplicity of illustration.

Combinations of the above-described embodiments of the present invention or portions thereof may be provided in one electronic device unit.

While the description provided herein describes hold-switch 20 to allow a user to indicate one of two states, the hold-switch also can be designed to indicate additional states by providing intermediate positions along the same. For example, the hold-switch apparatus may be adapted to provide tactile feedback to the user when the intermediate positions are reached.

In addition, although the description provided herein describes a particular functionality for hold-switch 20, the present invention can be applied to any actuator that provides an interface for a user to mechanically actuate a component disposed within the device. The actuator may permit the user to control any predetermined function of the device, not just a hold/lock function. Indeed, the functionality controlled by the user may even be a mechanical function rather than an electrical or software-based function as in the embodiments presented above.

Furthermore, the description provided herein illustrates electrical hold-switch 30 coupled to a circuit board using a flexible printed circuit, the electrical hold-switch also can couple to the circuit board using any other types of devices that can transmit electrical signals, e.g., a ribbon cable, other types of cable, wires, or a combination thereof.

Also, while the description of FIG. 4 illustrates methods of manufacturing hold-switch slide 28 in accordance with one embodiment of the present invention, other manufacturing techniques also can be used. For example, the hold-switch slide can be milled or cast from a rigid metal, polymeric material, or any other material having sufficiently strong mechanical properties.

The above described embodiments of the present invention are presented for purposes of illustration and not of limitation, and the present invention is limited only by the claims which follow.

What is claimed is:

1. A hold-switch slider for a portable electronic device comprising:

a continuous piece of material, the continuous piece of material comprising:

a single thickness portion comprising at least one slot for engaging a user interface; and a double thickness portion comprising a cutout for mating with a hold-switch, wherein the hold-switch slider translates along an axis of translation, and wherein the double thickness portion comprises a portion of the continuous piece of material folded about a fold axis that is parallel with the axis of translation.

2. The hold-switch slider of claim 1, wherein the at least one slot comprises four slots.

3. The hold-switch slider of claim 1, wherein the at least one slot comprises two pairs of slots.

4. A miniature media player comprising a hold-switch slider according to claim 1.

5. A hand-held media player comprising a hold-switch slider according to claim 1.

6. The hold-switch slider of claim 1, the hold-switch slider capable of indicating three different states of operation of a media player.

7. The hold-switch slider of claim 1, wherein:

the at least one slot comprises a pair of slots centered around a slot axis that is parallel with the axis of translation; and the slot axis is offset from the fold axis.

8. The hold-switch slider of claim 1, wherein the continuous piece of material is a continuous piece of rigid material.

9. The hold-switch slider of claim 1, wherein the double thickness portion comprises:

a first edge defined by the fold axis; and a second edge opposite the first edge, wherein the second edge includes the cutout.

10. An electronic device comprising:

a switch component comprising a moveable protuberance; and a mechanical actuator comprising:

an interface region comprising at least one slot for engaging a user interface; and an actuation region thicker than the interface region, wherein the actuation region mates with the switch component and moves the protuberance.

11. The electronic device of claim 10, wherein:

the actuation region has a thickness that is double that of the interface region; and the actuation region comprising a cutout for mating with the switch component.

12. The electronic device of claim 10, wherein the electronic device is a miniature media player.

13. The electronic device of claim 10, wherein the electronic device is a hand-held media player.

14. The electronic device of claim 10, wherein:

the mechanical actuator comprises a continuous piece of material;

the mechanical actuator translates along an axis of translation for moving the protuberance; and the actuation region comprises a portion of the continuous piece of material folded about a fold axis that is parallel with the axis of translation.

15. The electronic device of claim 14, wherein:

the interface region is centered around a slot axis that is parallel with the axis of translation; and the slot axis is offset from the fold axis.

16. The electronic device of claim 14, wherein the actuation region comprises:

a first edge defined by the fold axis; and a second edge opposite the first edge, wherein the second edge includes a cutout for mating with the switch component.

17. An electronic device comprising:

a switch component comprising a moveable protuberance; and a mechanical actuator comprising:

an interface region comprising at least one slot for engaging a user interface; and an actuation region comprising:

a first layer; and a second layer adjacent to the first layer, wherein the first layer and the second layer mate with the switch component and move the protuberance.

18. The electronic device of claim 17, wherein:

the actuation region has a thickness that is double that of the interface region; and the actuation region comprises a cutout through the first layer and the second layer for mating with the switch component.

19. The electronic device of claim 17, wherein the electronic device is a miniature media player.

20. The electronic device of claim 17, wherein the electronic device is a hand-held media player.

21. The electronic device of claim 17, wherein:

the mechanical actuator comprises a first portion of a continuous piece of material;

the first layer and the second layer translate along an axis of translation to move the protuberance; and the first layer and the second layer comprise a portion of the continuous piece of material folded about a fold axis that is parallel with the axis of translation.

22. The electronic device of claim 21, wherein:

the interface region is centered around a slot axis that is parallel with the axis of translation; and the slot axis is offset from the fold axis.

23. The electronic device of claim 21, wherein the actuation region comprises:

a first edge defined by the fold axis; and a second edge opposite the first edge, wherein the second edge includes a cutout through the first layer and the second layer for mating with the switch component.

* * * * *